US011141975B2

(12) United States Patent
Yamato et al.

(10) Patent No.: US 11,141,975 B2
(45) Date of Patent: Oct. 12, 2021

(54) MULTILAYER STRUCTURED ELEMENT SUBSTRATE, PRINTHEAD, AND PRINTING APPARATUS

(71) Applicant: CANON KABUSHIKI KAISHA, Tokyo (JP)

(72) Inventors: Hidenori Yamato, Tokyo (JP); Masataka Sakurai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/266,833

(22) Filed: Feb. 4, 2019

(65) Prior Publication Data

US 2019/0248133 A1 Aug. 15, 2019

(30) Foreign Application Priority Data

Feb. 15, 2018 (JP) ..... JP2018-025352

(51) Int. Cl.
*B41J 2/045* (2006.01)
*B41J 2/05* (2006.01)
(Continued)

(52) U.S. Cl.
CPC ..... *B41J 2/14129* (2013.01); *B41J 2/0458* (2013.01); *B41J 2/04528* (2013.01);
(Continued)

(58) Field of Classification Search
CPC .. B41J 2/04528; B41J 2/0453; B41J 2/04541; B41J 2/0458; B41J 2/05; B41J 2/14072; B41J 2/1408; B41J 2/14129; B41J 2/155
See application file for complete search history.

(56) References Cited

U.S. PATENT DOCUMENTS 7,152,972 B2 12/2006 King et al.
9,044,956 B2 6/2015 Silverbrook et al.
(Continued)

FOREIGN PATENT DOCUMENTS

CN 1576014 A 2/2005
CN 105818537 A 8/2016
(Continued)

OTHER PUBLICATIONS

Office Action dated Oct. 16, 2020, in counterpart application CN 201910110474.4 (17 pages).

*Primary Examiner* — Matthew Luu
*Assistant Examiner* — Kendrick X Liu
(74) *Attorney, Agent, or Firm* — Venable LLP

(57) ABSTRACT

According to one embodiment, a size of an element substrate is reduced, and a printhead using the element substrate can print high-quality image. The multilayer structured element substrate comprises a plurality of print elements, and a circuit configured to input a data signal and a clock signal used for driving the plurality of print elements. And, a print element array formed by arranging the plurality of print elements in line is diagonally arranged with respect to a side constituting an outer shape of the element substrate. A print element at one end of the print element array is a dummy element not contributing to printing. The circuit is provided not only at the same position as that of the dummy element but also in a layer different from that of the dummy element.

27 Claims, 12 Drawing Sheets

(51) Int. Cl.
*B41J 2/14* (2006.01)
*B41J 2/155* (2006.01)
*B41J 25/34* (2006.01)

(52) U.S. Cl.
CPC ..... *B41J 2/04541* (2013.01); *B41J 2/04553* (2013.01); *B41J 2/04585* (2013.01); *B41J 2/05* (2013.01); *B41J 2/1408* (2013.01); *B41J 2/14072* (2013.01); *B41J 2/14427* (2013.01); *B41J 2/155* (2013.01); *B41J 25/34* (2013.01); *B41J 2202/13* (2013.01); *B41J 2202/20* (2013.01)

(56) References Cited

U.S. PATENT DOCUMENTS

| | | | |
|---|---|---|---|
| 10,011,112 | B2 | 7/2018 | Takagi |
| 10,214,014 | B2 | 2/2019 | Komamiya et al. |
| 2005/0156981 | A1 | 7/2005 | Silverbrook et al. |
| 2014/0225957 | A1* | 8/2014 | Takahashi ..... H01L 24/49 347/20 |
| 2015/0165800 | A1 | 6/2015 | Silverbrook et al. |
| 2016/0059551 | A1* | 3/2016 | Miyazaki ..... B41J 2/14145 347/57 |
| 2017/0232737 | A1 | 8/2017 | Komamiya et al. |
| 2017/0341378 | A1 | 11/2017 | Sakurai et al. |
| 2018/0001632 | A1 | 1/2018 | Takagi |

FOREIGN PATENT DOCUMENTS

| | | | |
|---|---|---|---|
| CN | 106541705 | A | 3/2017 |
| CN | 107081960 | A | 8/2017 |
| CN | 107443899 | A | 12/2017 |
| CN | 107554072 | A | 1/2018 |
| EP | 2749424 | A1 | 7/2014 |
| JP | 2010-12795 | A | 1/2010 |
| JP | 5447238 | B2 | 3/2014 |
| JP | 2017-87686 | A | 5/2017 |
| JP | 2017-124588 | A | 7/2017 |

* cited by examiner

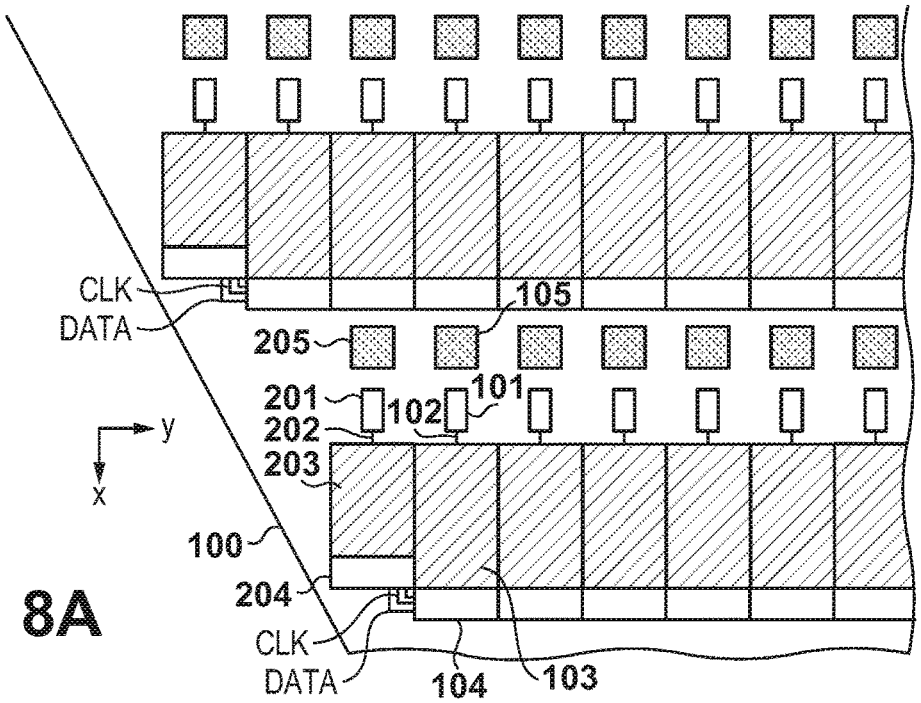
FIG. 8A
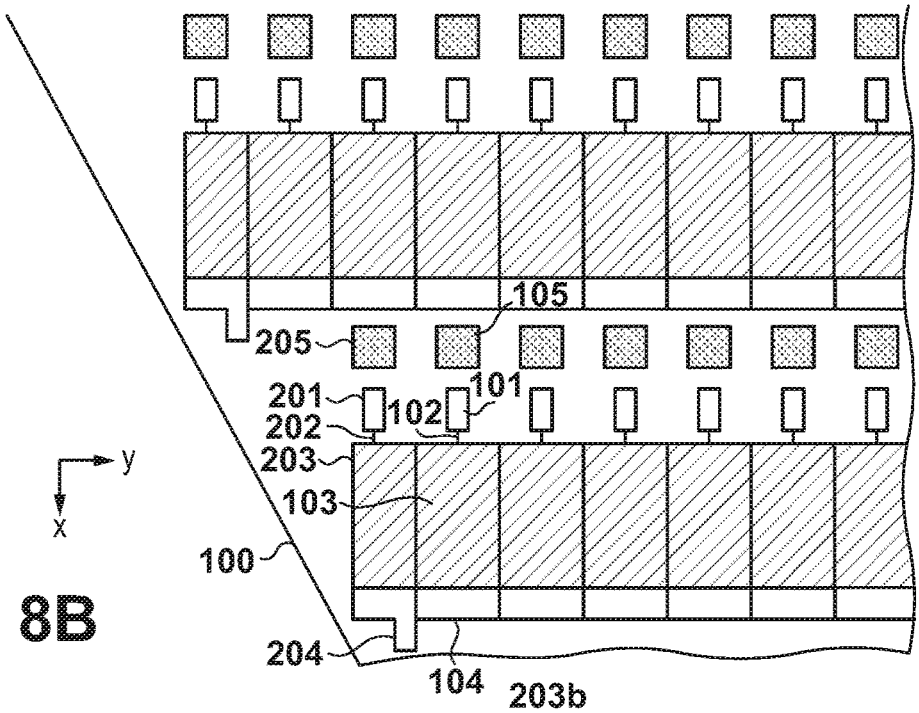
FIG. 8B
FIG. 8C
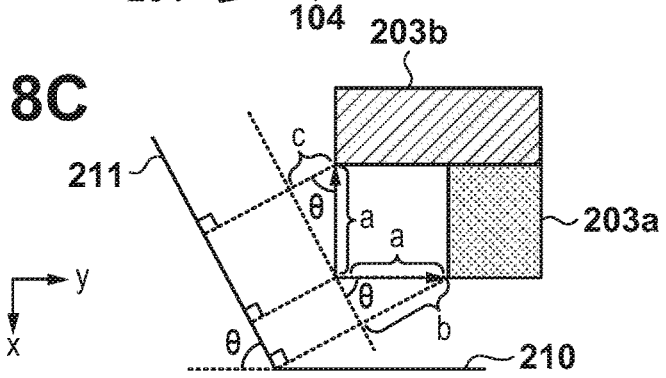

MULTILAYER STRUCTURED ELEMENT SUBSTRATE, PRINTHEAD, AND PRINTING APPARATUS

BACKGROUND OF THE INVENTION

Field of the Invention

The present invention relates to a multilayer structured element substrate, a printhead, and a printing apparatus, and particularly to, for example, a printing apparatus that employs a printhead which incorporates a plurality of multilayer structured element substrates including a plurality of print elements to perform printing in accordance with an inkjet method.

Description of the Related Art

There is known a thermal driving method of printing by arranging an electrothermal transducer (heater) in a portion that communicates with each orifice which discharges an ink droplet in an inkjet printhead, and causing ink droplets to be discharged onto a print medium by ink film boiling by supplying an electric current to heat each heater. In this arrangement, the printing apparatus transmits desired signals to an element substrate including a plurality of heaters, and a current is supplied to each heater by operating a corresponding driving circuit.

In recent years, a full-line printhead that has an arrangement in which a plurality of element substrates are arranged across a print width has become popular for commercial and industrial purposes. High-speed printing is possible when a full-line printhead is used because only the print medium needs to be conveyed. Japanese Patent Laid-Open No. 2010-012795 discloses an arrangement in which each element substrate is arranged so as to be offset vertically with respect to an orifice array direction between the connecting portions of adjacent element substrates. In addition, there is also an arrangement which allows the element substrates to be arranged in line by vertically offsetting the orifice array in each element substrate.

In addition, there is proposed a printing apparatus that uses, instead of a full-line printhead, a printhead that has an arrangement in which two or more element substrates are arranged adjacently to increase the printing length in one scan printing operation. In this case, even if printing is to be performed by reciprocally scanning a carriage including the printhead, the number of the carriage scan operations performed until the completion of printing can be reduced because the print width of the printhead is long.

In order to reduce the production cost of an element substrate, size reduction of the element substrate is required. Particularly, in an arrangement in which a plurality of element substrates are connected and arranged in a single array as described above, the size of the element substrate needs to be reduced for also the following reason.

FIGS. 12A and 12B are views showing the arrangement of a printhead in which two parallelogram-shaped substrate elements have been arranged adjacently. In FIG. 12A, assume that a downward direction is an x-direction plus side and an upward direction is an x-direction minus side. Also, a rightward direction is a y-direction plus side and a leftward direction is the y-direction minus side. Assume that the print medium is conveyed from the x-direction minus side to the x-direction plus side.

A plurality of heater arrays (five heater arrays in this case) formed by a plurality of heaters 101 are arranged parallel to each other in each element substrate 100. In addition, dummy heaters 201 are arranged at the respective ends of each heater array. Hence, a heater 101*a* at the end of each heater array forms a connecting portion with a heater 101*b* at the end of a corresponding heater array of an adjacent element substrate.

FIG. 12B shows a detailed layout arrangement of the connecting portion of the element substrate on the right side in FIG. 12A. As shown in FIG. 12B, a MOS transistor 103 and a selection circuit 104 corresponding to each heater 101 are arranged in the y direction at the same pitch as the heaters 101. Each supply port 105 supplies ink to the corresponding heater 101, and the ink is discharged from a corresponding orifice (not shown). The dummy heater 201 which has the shape as the heater 101 and does not contribute to printing is arranged at the end of the heater array in the y direction at the same pitch. A circuit 302 that controls the circuit operation in the heater array is arranged on the x-direction plus side (at the end of the heater array) of the dummy heater 201.

However, the above-described related art has the following problem.

Since the connecting portion of each element substrate 100 has a shape having an angle with respect to the x direction, if the circuit 302 to be arranged at the end of each heater array is large, the size of the element substrate will increase due to the constraint of the outer shape of the element substrate, and thus the length between the connecting portions of the adjacent element substrates will increase. If the length between connecting portions is long, it can create a difference in an air flow strength generated by the conveyance of the print medium between the orifices on the upstream side and the orifices on the downstream side in the conveyance direction of the print medium in the connecting portion, and the printing quality will degrade due to the shifting of the ink landed position.

Hence, since this difference becomes more evident when the conveyance speed of the print medium is increased to increase the printing speed, the heaters arranged at the connecting portions formed between the element substrates need to be arranged close to each other as much as possible.

SUMMARY OF THE INVENTION

Accordingly, the present invention is conceived as a response to the above-described disadvantages of the conventional art.

For example, a multilayer structured element substrate according to this invention is capable of reducing its size. In addition, a printhead and a printing apparatus according to this invention are capable of performing high quality printing even in a case in which a plurality of the element substrates are arranged in one array.

According to one aspect of the present invention, there is provided a multilayer structured element substrate comprising: an element array in which a plurality of print elements are arranged and a dummy element not contributing to printing is included; and a first circuit related to driving the plurality of print elements forming the element array, wherein the dummy element and the first circuit are arranged at a position where the dummy element and the first circuit at least partially overlap each other in a planar view of the element substrate.

According to another aspect of the present an invention, there is provided a printhead in which a plurality of the element substrates having the above-described arrangement are arranged along an element array direction and print elements are driven to discharge ink.

According to still another aspect of the present invention, there is provided a printing apparatus that prints an image by discharging ink onto a print medium by using a printhead which has the above-described arrangement.

According to still another aspect of the present invention, there is provided a multilayer structured element substrate comprising: an element array in which a plurality of print elements are arranged and a dummy element not contributing to printing is included; and a plurality of circuits configured to drive the plurality of print elements and the dummy element, respectively, wherein, among the plurality of circuits, an area of a circuit configured to drive the dummy element is smaller than an area of a circuit configured to drive the print element.

According to still another aspect of the present invention, there is provided a printhead in which a plurality of the element substrates having the above-described arrangement are arranged along an element array direction and print elements are driven to discharge ink.

According to still another aspect of the present invention, there is provided a printing apparatus that prints an image by discharging ink onto a print medium by using a printhead which has the above-described arrangement.

The invention is particularly advantageous since the size of an element substrate can be reduced. In addition, the invention has an effect of reducing the length between print elements arranged at the ends of respective element substrates forming the connecting portions of adjacent print elements. This can contributes to improving the image quality of an image to be printed by the printhead.

Further features of the present invention will become apparent from the following description of exemplary embodiments with reference to the attached drawings.

BRIEF DESCRIPTION OF THE DRAWINGS

FIGS. 8A, 8B, and 8C are views showing the layout arrangements of an element substrate according to the second embodiment;

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing Apparatus Including Full-Line Printhead (FIG. 1)>

Figure 1:
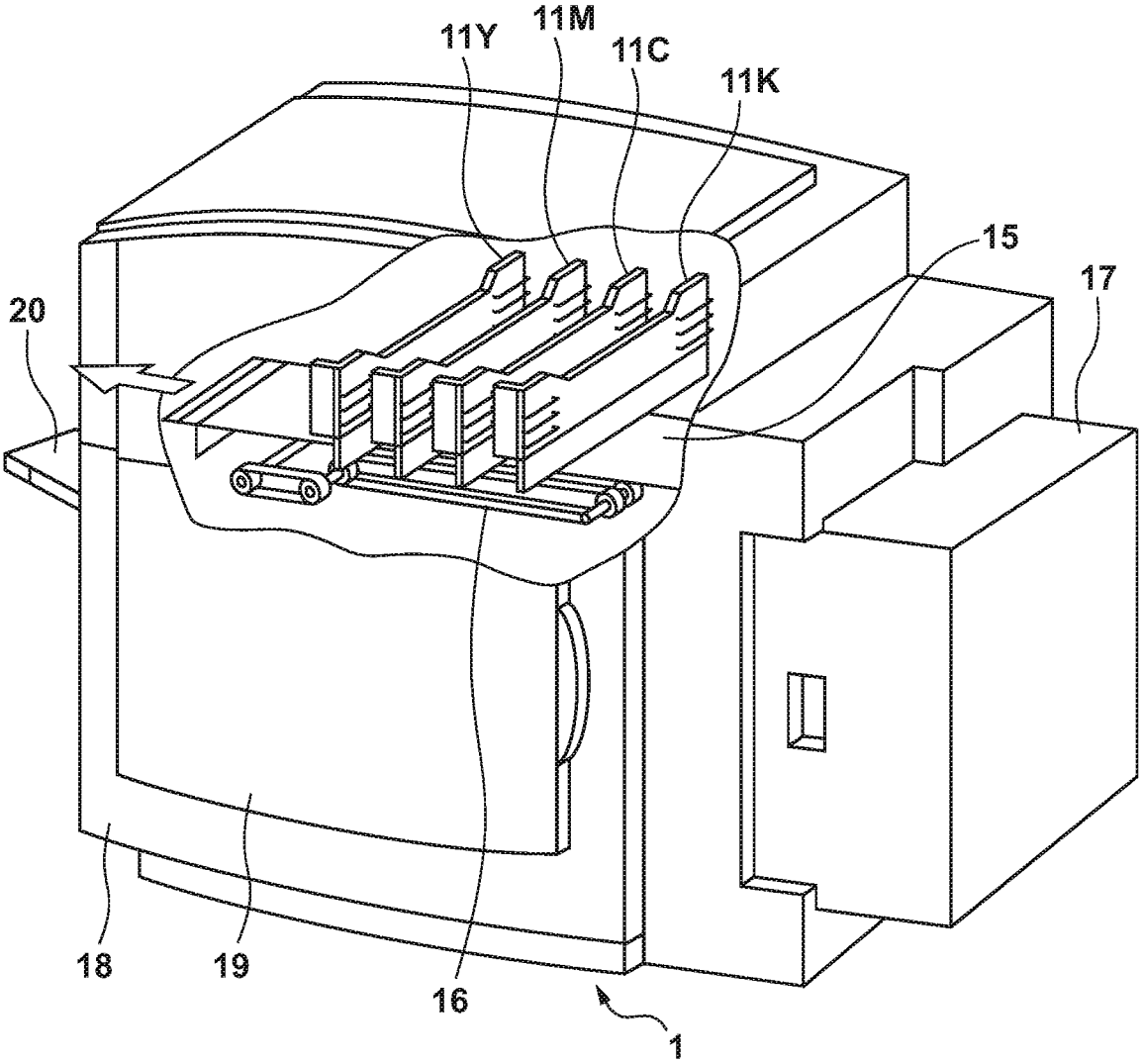
FIG. 1 is a perspective view for explaining the structure of a printing apparatus that includes a full-line printhead according to an exemplary embodiment of the present invention.

FIG. 1 is a perspective view for explaining the structure of a printing apparatus 1 that includes full-line inkjet printheads (to be referred to as printheads hereinafter) 11K, 11C, 11M, and 11Y and a recovery unit for ensuring a constantly stable ink discharge.

In the printing apparatus 1, a print sheet 15 is supplied from a feeder unit 17 to the respective printing positions of these printheads and is conveyed by a conveyance unit 16 included in a housing 18 of the printing apparatus.

To print an image onto the print sheet 15, the print sheet 15 is conveyed, and black (K) ink is discharged from the printhead 11K when the reference position of the print sheet 15 has reached a position under the printhead 11K that discharges black ink. In the same manner, corresponding color inks are discharged when the print sheet 15 reaches the reference positions of the printhead 11C that discharges cyan (C) ink, the printhead 11M that discharges magenta (M) ink, and the printhead 11Y that discharges yellow (Y) ink, respectively, thereby forming a color image. The print sheet 15 on which an image has been printed in this manner is discharged to a stacker tray 20 and stacked.

The printing apparatus 1 further includes the conveyance unit 16 and an exchangeable ink cartridge (not shown) for each ink to supply ink to each of the printheads 11K, 11C, 11M, and 11Y In addition, the printing apparatus further includes a pump unit (not shown) for supplying ink to and for performing recovery operation on each of the printheads 11K, 11C, 11M, and 11Y and a control substrate (not shown) for controlling the overall printing apparatus 1, and the like. A front door 19 is a door that can be opened and closed to exchange each ink cartridge.

A printhead 11 according to this embodiment employs an inkjet method of discharging ink by using thermal energy. Hence, the printhead includes an electrothermal transducer (heater). The electrothermal transducer is arranged in correspondence with each orifice, and ink is discharged from the orifice when a pulse voltage is applied to the corresponding electrothermal transducer in response to a print signal. Note that the printing apparatus is not limited to a printing apparatus using a full-line printhead that has a print width which corresponds to the width of a print medium as described above. The present invention is applicable to, for example, a so-called serial-type printing apparatus that includes, on a carriage, a printhead with orifices arranged in the conveyance direction of a print medium and performs printing by discharging ink onto the print medium while reciprocally scanning this carriage.

<Description of Control Arrangement (FIG. 2)>

The control arrangement for executing print control on the printing apparatus described with reference to FIG. 1 will be described next.

Figure 2:
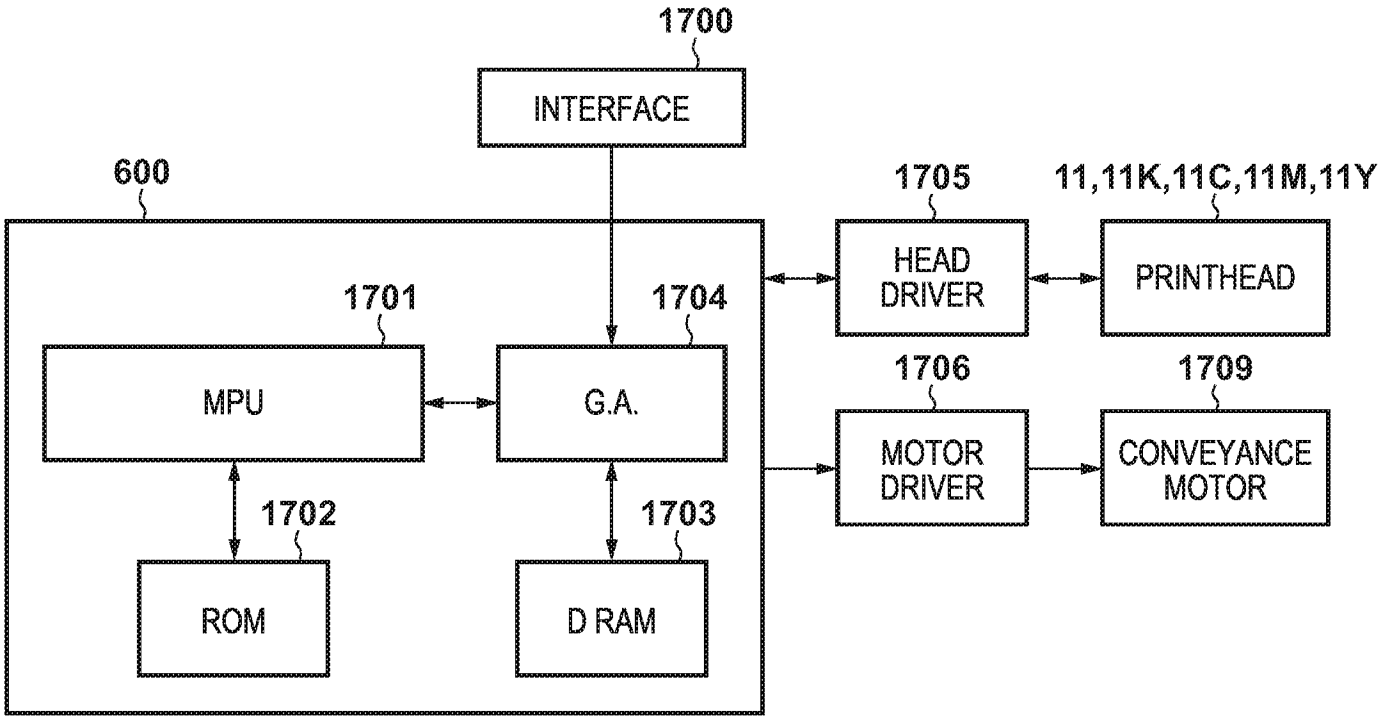
FIG. 2 is a block diagram showing the control arrangement of the printing apparatus shown in FIG. 1.

FIG. 2 is a block diagram showing the arrangement of a control circuit of the printing apparatus. In FIG. 2, reference numeral 1700 denotes an interface for inputting print data, reference numeral 1701 denotes an MPU, reference numeral 1702 denotes a ROM that stores a control program which is to be executed by the MPU 1701, and reference numeral 1703 denotes a DRAM for storing data such as print data, data of a print signal to be supplied to a printhead, and the like. A gate array (G. A.) 1704 controls the supplying of print signals to the printhead and also controls the data transfer between the interface 1700, the MPU 1701, and the DRAM 1703. A controller 600 includes the MPU 1701, the ROM 1702, the DRAM 1703, and the gate array 1704. Reference numeral 1710 denotes a carriage motor for conveying the printheads 11 (11K, 11C, 11M, and 11Y), and reference numeral 1709 denotes a conveyance motor for conveying print sheets. Reference numeral 1705 denotes a head driver for driving each printhead, and reference numeral 1706 denotes a motor driver for driving the conveyance motor 1709.

The operation of the aforementioned control arrangement will be described. When print data is input to the interface 1700, the print data is converted, between the gate array 1704 and the MPU 1701, into a print signal for printing. Printing is performed by driving each printhead in accordance with the print data transmitted to the head driver 1705 together with the driving of the motor driver 1706. Also, the transfer error (to be described later) information obtained from each printhead is fed back to the MPU 1701 via the head driver 1705, and the information is reflected on print control.

Figure 3:
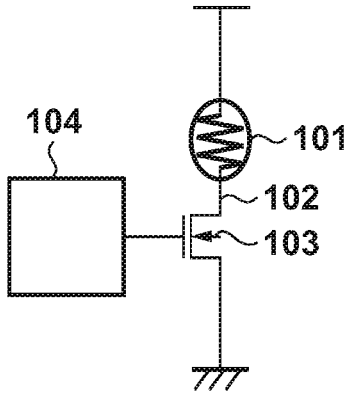
FIG. 3 is a view showing the arrangement of a heater and its driving circuit.

FIG. 3 is a view showing the circuit arrangement of a heater forming a print element and its driving circuit.

As shown in FIG. 3, a heater 101 is connected, via a wiring 102, to a MOS transistor 103 that switches the driving of the heater 101. A selection circuit 104 is connected to the MOS transistor 103, and the selection circuit 104 outputs a selection signal to control ON/OFF of the MOS transistor 103. As a result, an electric current flows onto the desired heater 101, and ink is discharged to a print medium by this energy. The selection circuit 104 includes a circuit (for example, a shift register circuit and a latch circuit) for outputting the selection signal, a wiring for transferring the signal, a wiring for supplying power, and the like. A voltage transformer for supplying voltage to be input to the MOS transistor 103 may also be included. This combination of the MOS transistor and the selection circuit will be referred to as a driving circuit.

Each of the printheads 11K, 11C, 11M, and 11Y includes an element substrate including a plurality of heaters and their driving circuits each arranged in the manner shown in FIG. 3. A plurality of these element substrates are arranged to increase the print width, thereby forming a full-line printhead whose print width corresponds to the width of the print medium.

Figure 11:
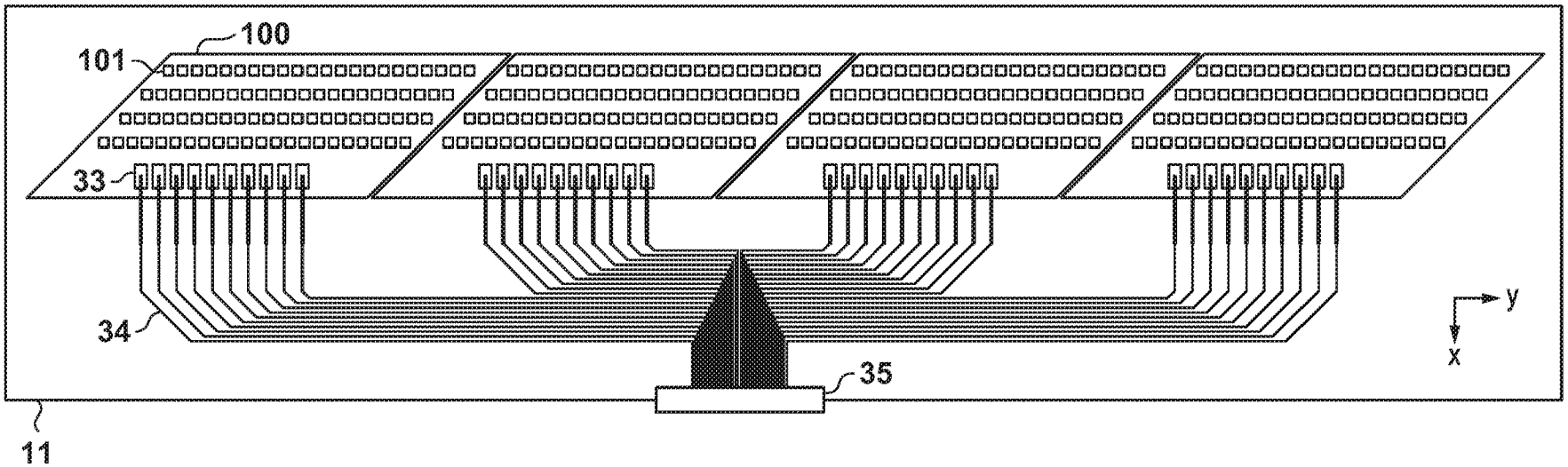
FIG. 11 is a view showing an example of the arrangement of the element substrate in the printhead according to the embodiment.

FIG. 11 is a view showing an example of the arrangement of a printhead according to an exemplary example of the present invention. The full-line printhead according to this embodiment employs an arrangement in which a plurality of parallelogram-shaped element substrates 100 are arranged in a single line in a heater array direction.

In a printhead 11, a signal is transferred and power is supplied from the printing apparatus 1 to a connector 35, and the signal and the power are connected to each pad 33 of the element substrate 100 via a corresponding head wiring 34. The printhead 11 which includes four element substrates 100 will be exemplified here. On each element substrate 100, the heaters 101 are arranged across a plurality of arrays (four arrays in this case). In each element substrate 100, of the sides forming the outer shape of the element substrate 100, each side positioned near the adjacent element substrate 100 extends in a direction intersecting with the heater array direction. In FIG. 11, assume that the downward direction is an x-direction plus side and the upward direction is an x-direction minus side. Also, the rightward direction is a y-direction plus side and the leftward direction is a y-direction minus side. Assume that the print medium is conveyed from the x-direction plus side to the x-direction minus side.

The arrangement shown in FIG. 11 allows the length between the heaters in the connecting portions of the adjacent element substrates 100 to be decreased more than an arrangement in which a plurality of element substrates are arranged in a staggered manner. In addition, the arrangement of FIG. 11 can downsize the overall printhead because the size of the arrangement in the x direction can be reduced by arranging the element substrates in a single line. Also, in the arrangement of FIG. 11, ink land position shift can be reduced because the length between the heaters in the connecting portions of adjacent element substrates 100 can be shortened even if the print medium is conveyed skewed with respect to the printhead 11.

By making the connecting portions of the element substrates have an angled shape and arranging the element substrates linearly in the above described manner, the length between the heaters of the connecting portions of adjacent element substrates can be shorter than those of a case in which the element substrates are arranged in a staggered manner.

Several embodiments related to element substrates mounted on a printhead included in a printing apparatus with the above-described arrangement will be described next.

First Embodiment

Figure 4A:
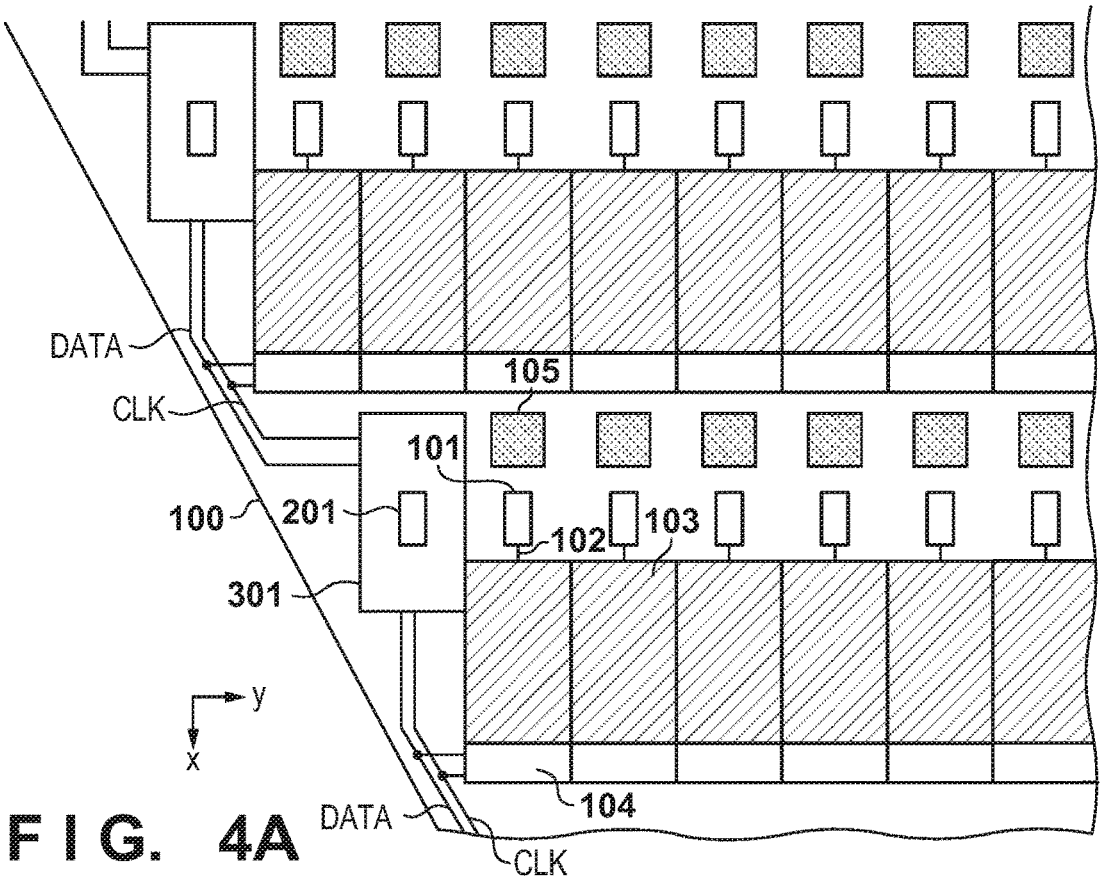
FIGS. 4A, 4B, and 4C are views showing the layout arrangements of an element substrate according to the first embodiment.
Figure 4B:
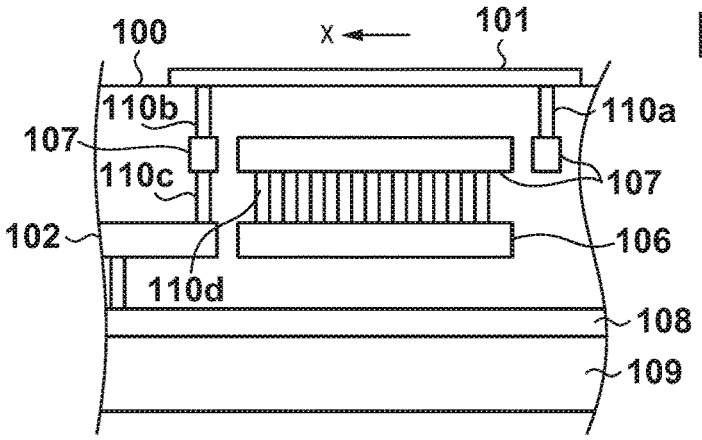
Figure 4C:
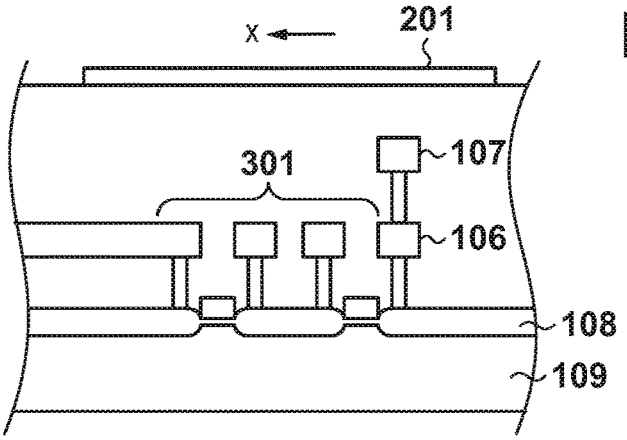

FIGS. 4A to 4C are views showing the layout arrangements of element substrates according to the first embodiment. Note that in FIGS. 4A to 4C, the same reference numerals denote the components which are the same as those described already in FIG. 3 and FIGS. 12A and 12B, and a description thereof will be omitted.

As shown in FIG. 4A, a dummy heater 201 that has the same shape as each heater 101 but does not contribute to printing is arranged at the end of each heater array (print element array) in the y direction at the same pitch. Each dummy heater 201 is not connected to a driving circuit and does not have a function as a circuit. The dummy heaters are arranged to reduce shape variation since it can prevent the shape of the heaters arranged at the ends from varying due to the density distribution when the element substrate is formed by using a semiconductor manufacturing process.

A nozzle arranged in correspondence with each heater may be arranged on the dummy heater to improve the stability of its shape. Since a supply port 105 and a MOS transistor 103 need not be arranged for the dummy heater 201, a timing adjustment circuit 301 that adjusts the timings of a clock signal CLK and a data signal DATA which are transferred from the x-direction plus side is arranged immediately below the dummy heater 201. Note that "immediately below the dummy heater 201" indicates a state in which the circuit is arranged at a position where the dummy heater 201 and the timing adjustment circuit 301 partially overlap each other in a planar view of the element substrate 100. Note that, in order to reduce the area of the element substrate, it is preferable to arrange the dummy heater 201 within the region of the timing adjustment circuit 301 in a planar view of the element substrate as shown in FIG. 4A.

The clock signal CLK and the data signal DATA whose phases have been adjusted by the timing adjustment circuit 301 are output to the x-direction minus side, and are transmitted to the timing adjustment circuit of each adjacent heater array. The clock signal CLK and data signal DATA are also input to each selection circuit 104. Each selection circuit 104 is formed from a shift register circuit and a latch circuit that transfer the data signal DATA, and transfers driving data to the MOS transistor of the corresponding heater. The clock signal CLK and the data signal DATA input from each pad of the element substrate 100 are internally processed in the element substrate 100 and transferred to each heater array. However, since a phase difference will be generated between the clock signal CLK and the data signal DATA if the transfer length is long, the timing adjustment circuit 301 is arranged in the middle in this embodiment.

Since the timing adjustment circuit 301 adjusts the timings of the clock signal CLK and the data signal DATA and transfers the adjusted clock signal CLK and the adjusted data signal DATA to the selection circuits 104 of each heater array, the timing adjustment circuit 301 is arranged at the end of each heater array. In this embodiment, particularly, by arranging the timing adjustment circuit 301 immediately below the dummy heater, the timing adjustment of the clock signal CLK and the data signal DATA to be transmitted to the corresponding heater array is performed at the end of the array. In addition, by arranging the timing adjustment circuit 301 immediately below the dummy heater at the end of each heater array, each timing adjustment circuit 301 is connected to a clock signal line and a data signal line arranged at the end of the element substrate 100. These timing adjustment circuits 301 are connected to a control circuit (not shown) via these signal lines.

Note that a circuit to be arranged immediately below the dummy heater 201 is not limited to the timing adjustment circuit 301, and a decoder or the like may be arranged.

An arrangement including a decoder will be described as another example of a circuit to be arranged below each dummy heater 201. Since the circuit area will increase if the shift register circuit and the latch circuit of the selection circuit 104 are arranged for each heater, an arrangement in which the plurality of heaters of a heater array are divided into time-divisional drive groups is adopted. In this kind of an arrangement, a desired heater is selected by obtaining AND of the driving data for each group and the driving data for each time-divisional driving operation. In this case, the decoder expands the data signal DATA used for the time-divisional driving operation and transmits the data signal DATA for selecting only the heaters of the selected group. Since this decoder is arranged at the first stage or the end stage of the shift register circuit, it will be arranged at the end of the heater array.

In this manner, since a circuit for integrally processing the operations of one array of heaters is required to be arranged at the end of this heater array, it is possible to reduce the arrangement area by arranging this circuit immediately below the dummy heater which is arranged at the end of the heater array. Note that this circuit need not be a circuit that processes the operations of all of the heaters included in one heater array, and suffices to be a circuit for processing the operations of the plurality of heaters included in the one heater array.

As is obvious from the above description, the element substrate 100 has a multilayer structure. An arrangement in which two wiring layers and a layer for arranging the heaters formed on the two wiring layers will be described here.

FIG. 4B is a view showing an x-direction section of the heater 101.

As shown in FIG. 4B, the element substrate 100 has a multilayer structure in which an insulating layer 108 is arranged on a base 109, two wiring layers 106 and 107 are arranged above the insulating layer 108, and the heater 101 is arranged above the wiring layers.

The x-direction minus side of the heater 101 is connected to a driving power supply via a via 110*a* and the wiring layer 107, and the x-direction plus side of the heater 101 is connected to a MOS transistor 103 via a via 110*b*, the wiring layer 107, a via 110*c*, and a wiring 102. The wiring layer 106, the wiring layer 107, and a via 110*d* connecting these layers are arranged immediately below the heater 101 to improve heat dissipation at the time of a driving operation. The wiring layers 106 and 107 for heat dissipation which are arranged immediately below the heater 101 each have a comparatively large surface area and are not connected to the heater 101.

FIG. 4C is a view showing an x-direction section of the dummy heater 201. Since the dummy heater 201 is not used for the driving operation, there is no need to arrange wiring layers and vias for heat dissipation, and it is possible to arrange any desired circuit and wiring.

Immediately below the dummy heater shown in FIG. 4C, the MOS transistor is formed on the insulating layer 108, and the timing adjustment circuit 301 has been arranged by using the wiring layer 106 and the wiring layer 107.

By adopting such an element substrate structure, even if the dummy heater 201 is arranged, the size of the element substrate can be reduced while avoiding a state in which an integrated circuit interferes with the outer shape of the element substrate 100 by arranging the circuit immediately below the dummy heater. In addition, the length between the connecting portions of adjacent element substrates can be shortened because the heater 101 that contributes to printing at the end of the heater array can be brought closer to the periphery of the element substrate 100. As a result, it is possible to reduce the ink droplet land position shift amount due to the air flow caused by the conveyance of the print medium at printing and suppress ink land position shift even when the print medium is conveyed skewed with respect to the heater array.

Modified Example 1

Figure 5:
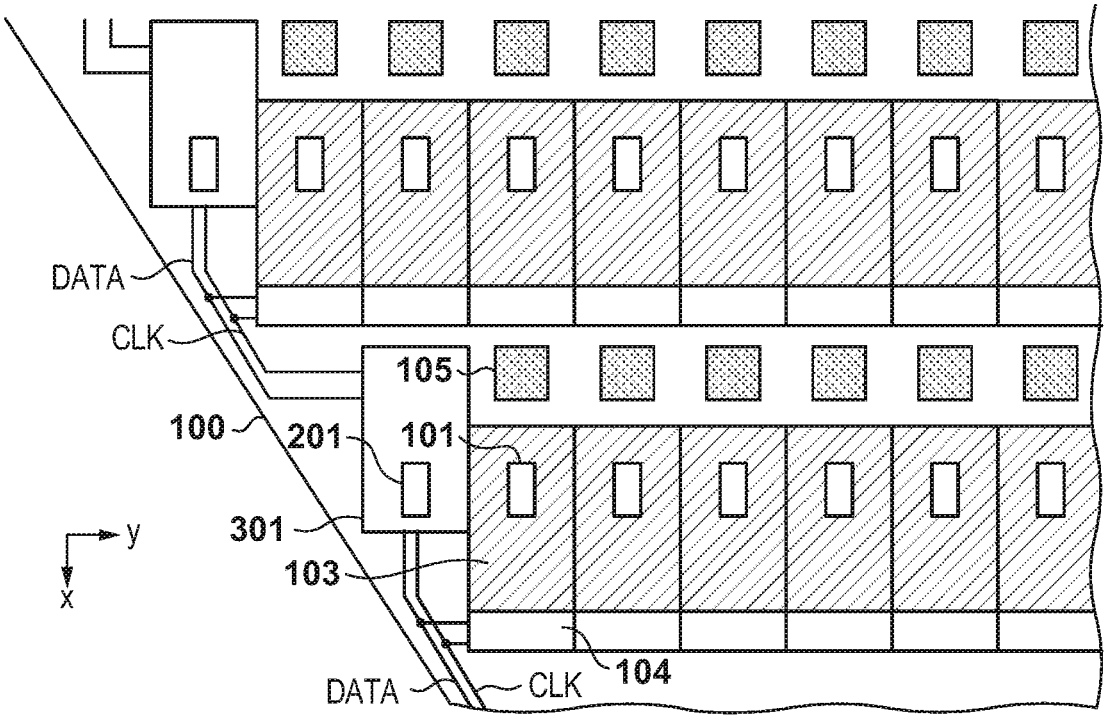
FIG. 5 is a view showing the layout arrangement of an element substrate according to modified example 1 of the first embodiment.

FIG. 5 is view showing the layout arrangement of an element substrate according to modified example 1 of the first embodiment.

As is obvious from comparing FIG. 5 and FIG. 4A, the MOS transistor 103 is arranged immediately below each heater 101 in this example. Since the MOS transistor need not be arranged immediately below the dummy heater 201 in the same manner as the arrangement of FIG. 4A, the size of the substrate element can be reduced by arranging the timing adjustment circuit 301 below the dummy heater.

Modified Example 2

Figure 6:
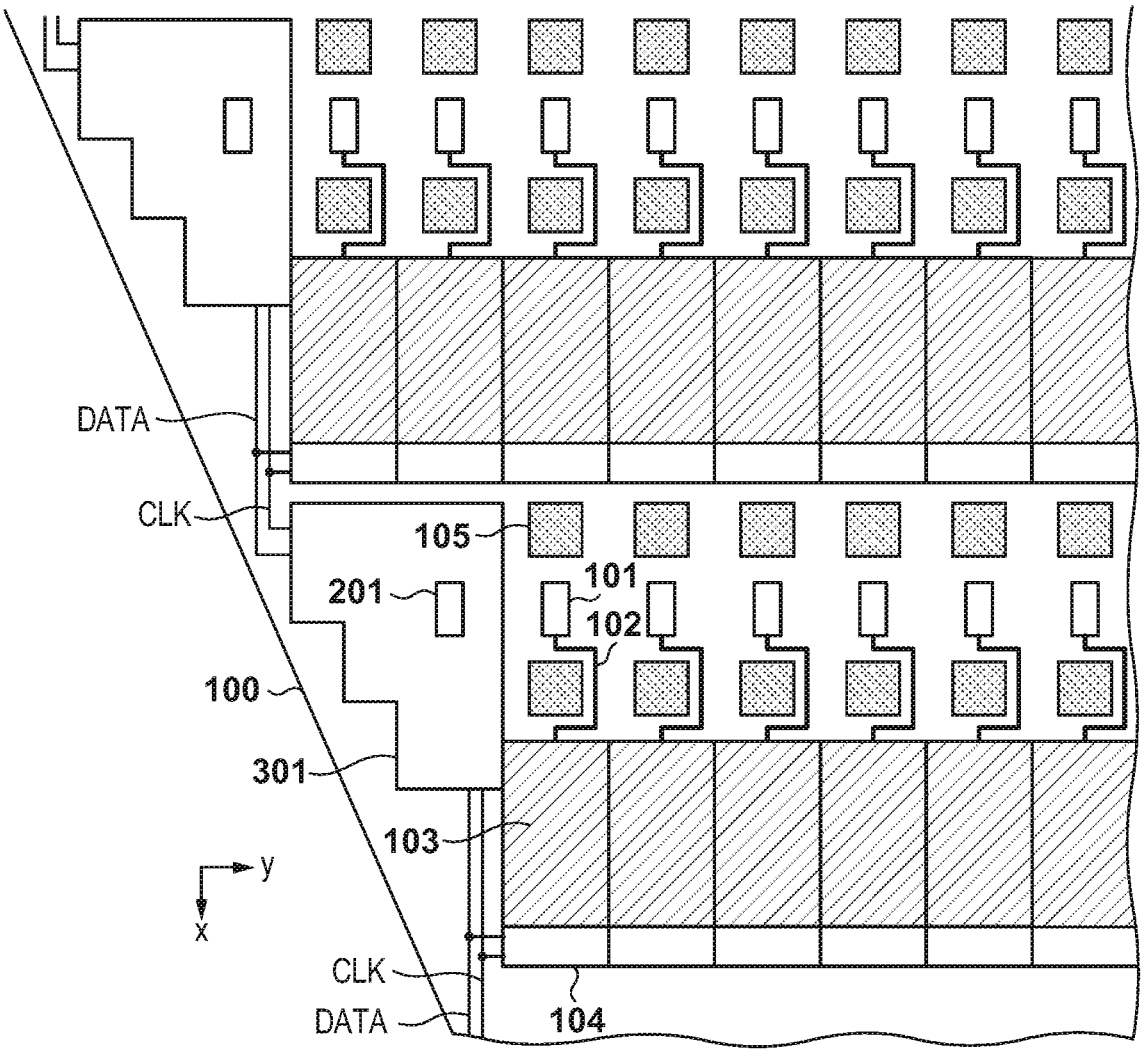
FIG. 6 is the layout arrangement of an element substrate according to modified example 2 of the first embodiment.

FIG. 6 is a view showing the layout arrangement of an element substrate according to modified example 2 of the first embodiment.

As is obvious from comparing FIG. 6 and FIG. 4A, two supply ports 105 are arranged on both sides of each heater 101 in the x direction so as to sandwich the heater 101 in this example. The wiring 102 connects the heater 101 to the corresponding MOS transistor 103 by bypassing the supply port 105 arranged on the x-direction plus side. In a case in which the circuit scale of the timing adjustment circuit is large, a portion of the timing adjustment circuit 301 that is along the side of the outer shape of the element substrate is formed to have a stepwise shape in accordance with the angle (tilt) with respect to the side and the heater array direction as shown in FIG. 6. As a result, the size of the element substrate can be reduced in the same manner as those of the arrangements shown in FIGS. 4A to 5. Note that it may be arranged so that one of the two openings for the ink flow is set as the supply port 105 and the other is set as a collection port for collecting ink. That is, it may be arranged so that ink will be circulated by causing the ink supplied from the supply port to pass through a compression chamber in which the heater 101 is arranged and collecting the ink by the collection port.

Other examples of the shape of the element substrate will be described here.

Figure 12A:
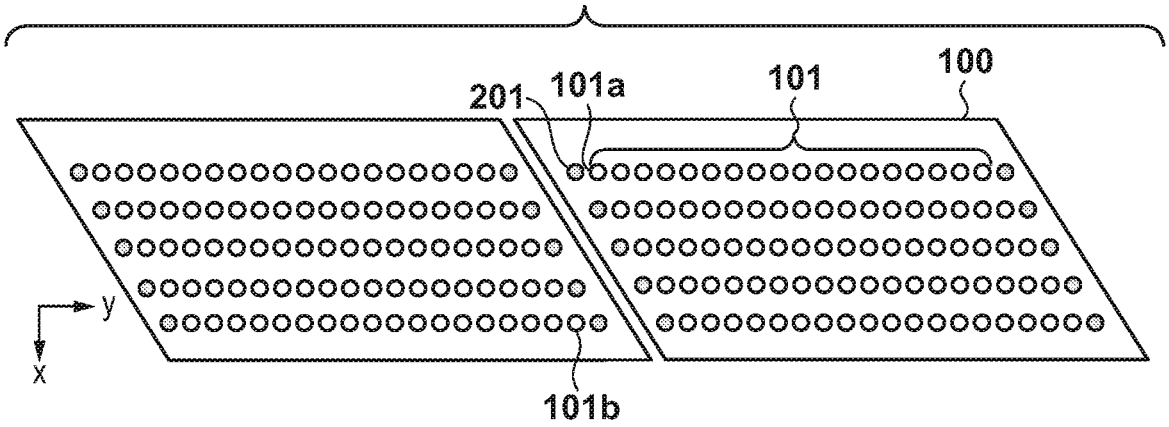
FIGS. 12A and 12B are views showing a comparative example of a printhead according to a related art.
Figure 12B:
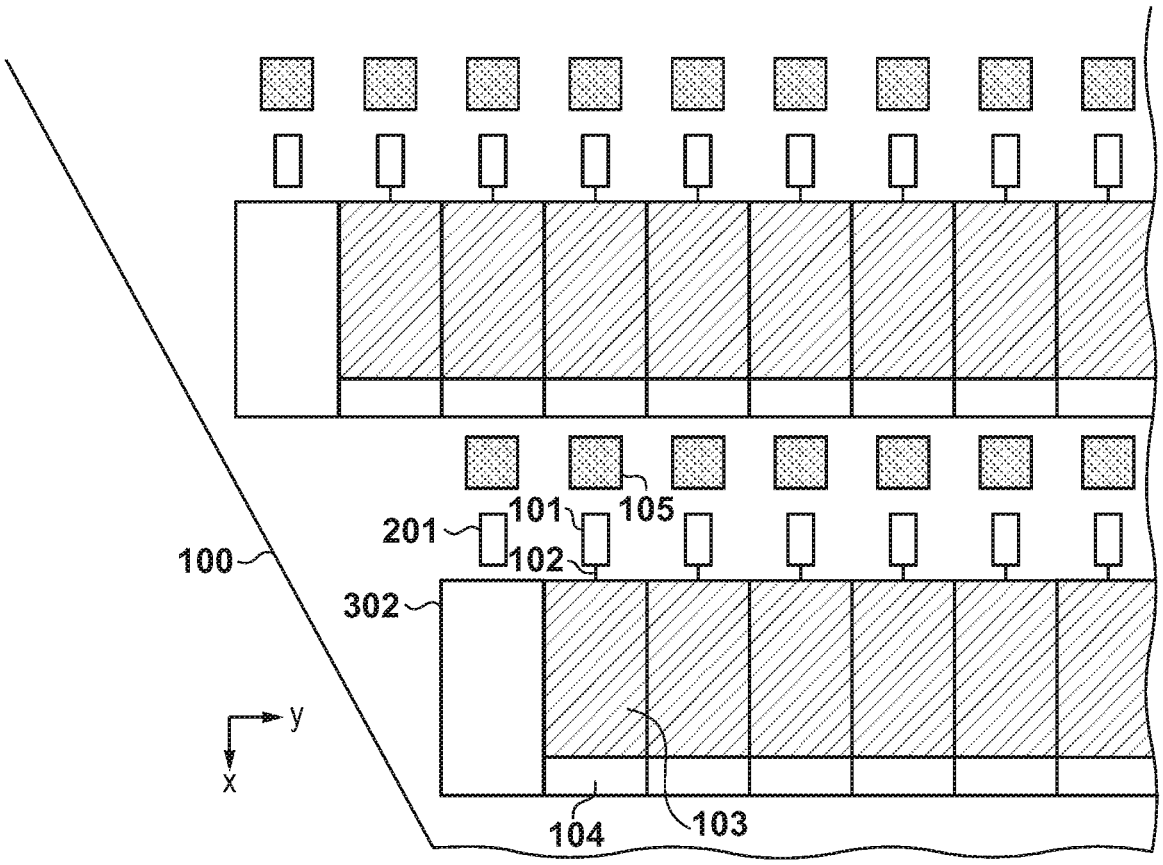

Although a parallelogram shape as that shown in FIG. 12A has been assumed for the element substrate shown in FIG. 4A, the shape of the element substrate may be a trapezoid or a rectangle.

Figure 7A:
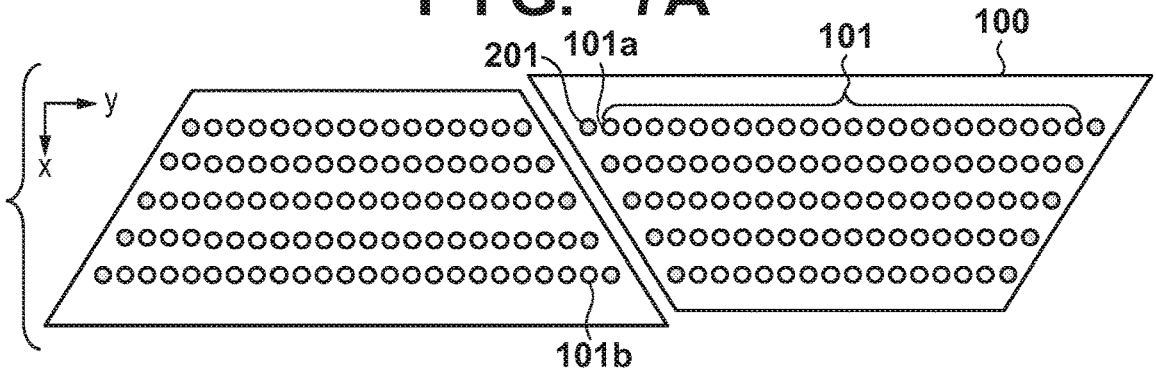
FIGS. 7A, 7B, and 7C are views showing examples of element substrates with other shapes.
Figure 7B:
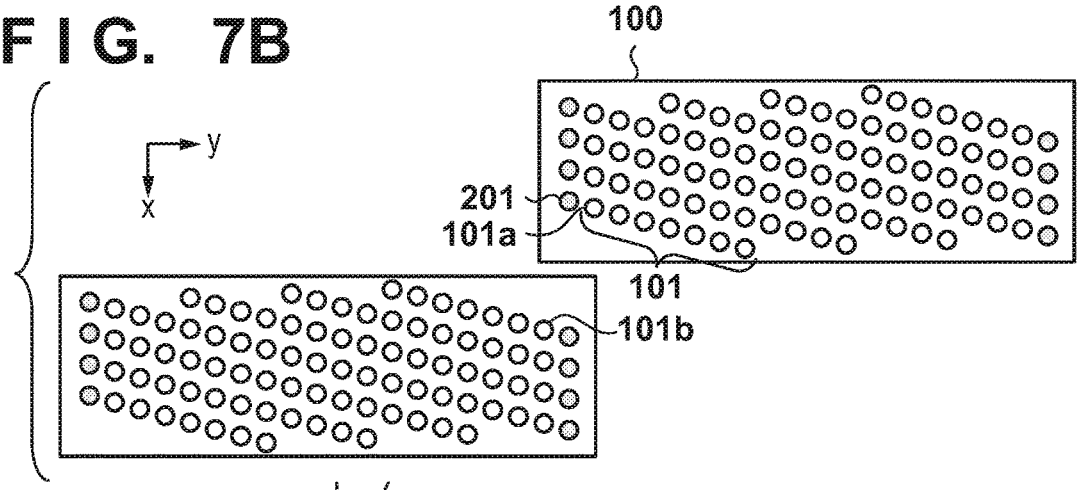
Figure 7C:
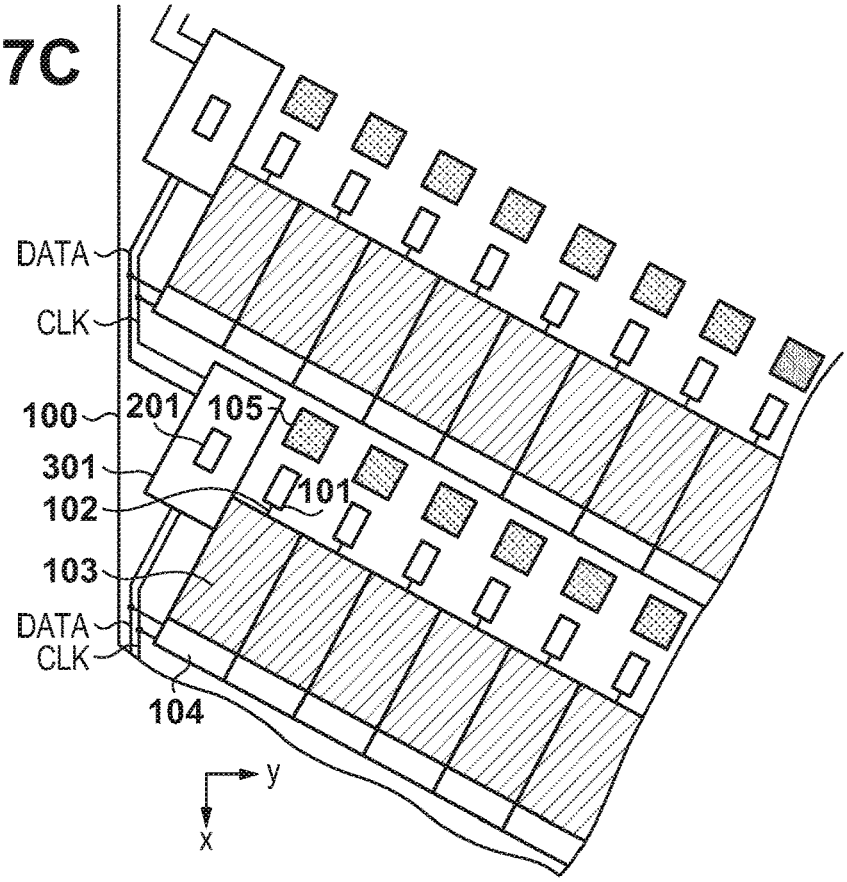

FIGS. 7A to 7C are views showing examples of the other shapes of the element substrate.

FIG. 7A shows an example in which the shape of each element substrate is a trapezoid, and the connecting portion is formed by arranging an element substrate in the y direction while inverting the x-direction orientation of the element substrate. Note that the x direction and the y direction are perpendicular to each other. The arrangement of the ends of the heater arrays is the same as those shown in FIGS. 4A to 6, and the same effect can be obtained.

In FIG. 7B, the shape of the element substrate is a rectangle, and each heater array formed from the plurality of heaters 101 is arranged obliquely with respect to a long side (y direction) of the element substrate 100. The density of the pitch of the heaters 101 can be increased in accordance with the angle formed by obliquely arranging each heater array with respect to the y direction.

FIG. 7C is an enlarged view of the layout arrangement of the end of the element substrate 100. As shown in FIG. 7B, the short side of the element substrate 100 is parallel to the x direction, and the heater arrays and the circuits are arranged obliquely. The same effect as that shown in FIGS. 4A to 4C can also be obtained in this case by arranging the circuit in the layer below each dummy heater 201 at the end of the element substrate.

As described above, the shape of the element substrate and the direction of the heater arrays can be combined in various kinds of ways to form an arrangement.

Hence, according to the above-described embodiment, the size of the element substrate can be reduced by arranging a logic circuit such as the timing adjustment circuit immediately below the dummy heater at the end of each heater array. In addition, it is possible to reduce the length of the connecting portions between adjacent element substrates, reduce the ink land position shift amount due to the air flow caused by the conveyance of the print medium during a printing operation, and suppress the ink land position shift even when the print medium is conveyed skewed with respect to the heater array. As a result, high-quality image printing can be achieved.

Note that although the above-described embodiment has described an example in which one dummy heater is arranged at the end of each heater array, the present invention is not limited to this. A plurality of dummy heaters may be arranged.

In addition, the circuit arranged immediately below the dummy heater need not be only the timing adjustment circuit or the decoder. For example, there is an arrangement in which a detection element for detecting temperature information in correspondence with each heater of the heater array is used, and a detection element array formed by arranging the detection elements is arranged for each heater array. It is possible to identify the discharge failure of an orifice based on the detection result of the detection element and reflect this information to a complementary image print operation or to a head recovery job. The detection element is, therefore, a circuit indirectly related to driving control of the heaters. The circuit to be arranged immediately below the dummy heater can be a reference voltage source, a reference current source, and the like in this detection element circuit. That is, the circuit to be arranged immediately below the dummy heater is not limited to a circuit directly related to driving the heaters of the heater array and suffices to be a circuit related to the driving control of the heaters of the heater array. In addition, the same circuit need not be always arranged for all of the heater arrays, and different circuits may be arranged.

Furthermore, dummy heaters may be arranged at both ends of each heater array, and a circuit for driving a plurality of heaters included in the heater array may be arranged immediately below each of the dummy heaters at both ends. In this case, circuits that have different functions from each other may be arranged immediately below the dummy heaters at the respective ends. For example, the timing adjustment circuit may be arranged immediately below the dummy heater at one end of the heater array, and the decoder may be arranged immediately below the dummy heater at the other end of the heater array. By arranging different circuits at the ends, the areas required for the respective circuits can be ensured, and the size of the element substrate can be further reduced.

Note that there may be a case in which it is possible to perform processing without arranging the timing adjustment circuit for every heater array. In such a case, the timing adjustment circuit can be arranged immediately below each of the dummy heaters included in some of the heater arrays, and the timing adjustment circuit need not be arranged immediately below each of the dummy heaters included in the remaining heater arrays.

In addition, although an arrangement in which the dummy heater is arranged at the end of the heater array has been described, the position of the dummy heater is not limited to the end of the heater array, and the dummy heater may be arranged in the middle of the heater array. In this arrangement as well, the area of the element substrate can be reduced by arranging the circuit for driving a plurality of print elements included in the heater array immediately below the dummy heater.

Second Embodiment

FIGS. 8A to 8C are views each showing the layout arrangement of an element substrate according to the second embodiment. Note that, in FIGS. 8A to 8C, the same reference numerals denote the same components as those already described in FIG. 3, FIGS. 4A to 4C, and FIGS. 12A and 12B, and a description thereof will be omitted.

In this embodiment, in order to use each dummy heater 201 in the preliminary discharge operation, a supply port 205, a MOS transistor 203, and a selection circuit 204 are included in correspondence with the dummy heater 201 in the same manner as the heater 101. Each dummy heater 201 is connected to the corresponding MOS transistor 203 by a wiring 202. The selection circuit 204 transmits a dummy heater selection signal to control the ON/OFF of the MOS transistor 203. As a result, an electric current flows to the dummy heater 201, and ink is discharged by this energy.

Since the dummy heater 201 is not used to perform printing on a print medium, there is no need to strictly control its discharge characteristics compared to the heater 101. Hence, the MOS transistor 203 corresponding to the dummy heater 201 can have a lower driving capability than a MOS transistor 103 corresponding to the heater 101. That is, it becomes possible to reduce the circuit size on the x-direction minus side by reducing the gate width of the MOS transistor 203. The position of the selection circuit 204 can be shifted to the x-direction minus side in correspondence with this reduction. A clock signal CLK and a data signal DATA to be used for the selection circuit 204 are transmitted from a selection circuit 104 as shown in FIG. 8A.

It is possible to reduce the size of the element substrate by downsizing the MOS transistor 203 corresponding to the dummy heater 201 by using the above-described arrangement. In addition, the length between the connecting portions of the adjacent element substrates can be reduced because the heater 101 that contributes to printing at the end of each heater array can be brought closer to the periphery of the element substrate 100. As a result, the ink land position shift amount due to an air flow caused by the conveyance of the print medium during the printing operation can be reduced, and the ink land position shift can be suppressed even in a case in which the print medium is conveyed skewed with respect to the heater array.

Also, as shown in FIG. 8B, reduction in the y direction is also possible by reducing the gate length of the MOS transistor by reducing the number of gates of the MOS transistor 203. The selection circuit 204 may be reduced along with the MOS transistor 203, or its influence on the size of the element substrate can be eliminated by making the selection circuit have a stepwise shape in accordance with the outer angle of the element substrate as shown in FIG. 8B.

In addition, as shown in FIG. 8C, the effect from the reduction in the y direction and the effect from reducing the reduction in the x direction will differ depending on an angle (element substrate angle) 0 on an acute-angle side formed by an intersection of a side 211 of the outer shape of the element substrate and a line 210 extending from the center of the heater in the heater array direction.

First, in a case in which the transistor is reduced by a length a in the x direction, the circuit shape of a MOS transistor 203*a* is increased by a length b from the side 211 of the outer shape oblique with respect to the y direction to the circuit end. In contrast, in a case in which the transistor is reduced by the length a in the y direction, the circuit shape of a MOS transistor 203*b* is increased by a length c from the side 211 of the outer shape oblique with respect to the y direction to the circuit end. As is obvious from FIG. 8C, $b=\sin\theta/a$ and $c=\cos\theta/a$.

Hence, in a case in which the element substrate angle $\theta$ is equal to or larger than 45° ($\theta \geq 45$), a greater size reduction effect can be obtained by performing reduction in the x direction more than in the y direction because the element substrate size can be reduced more. On the other hand, in a case in which the element substrate angle is smaller than 45° ($\theta < 45$), a greater size reduction effect can be obtained by performing reduction in the y direction more than in the x direction because the element substrate size can be reduced more.

Modified Example 1

Figure 9:
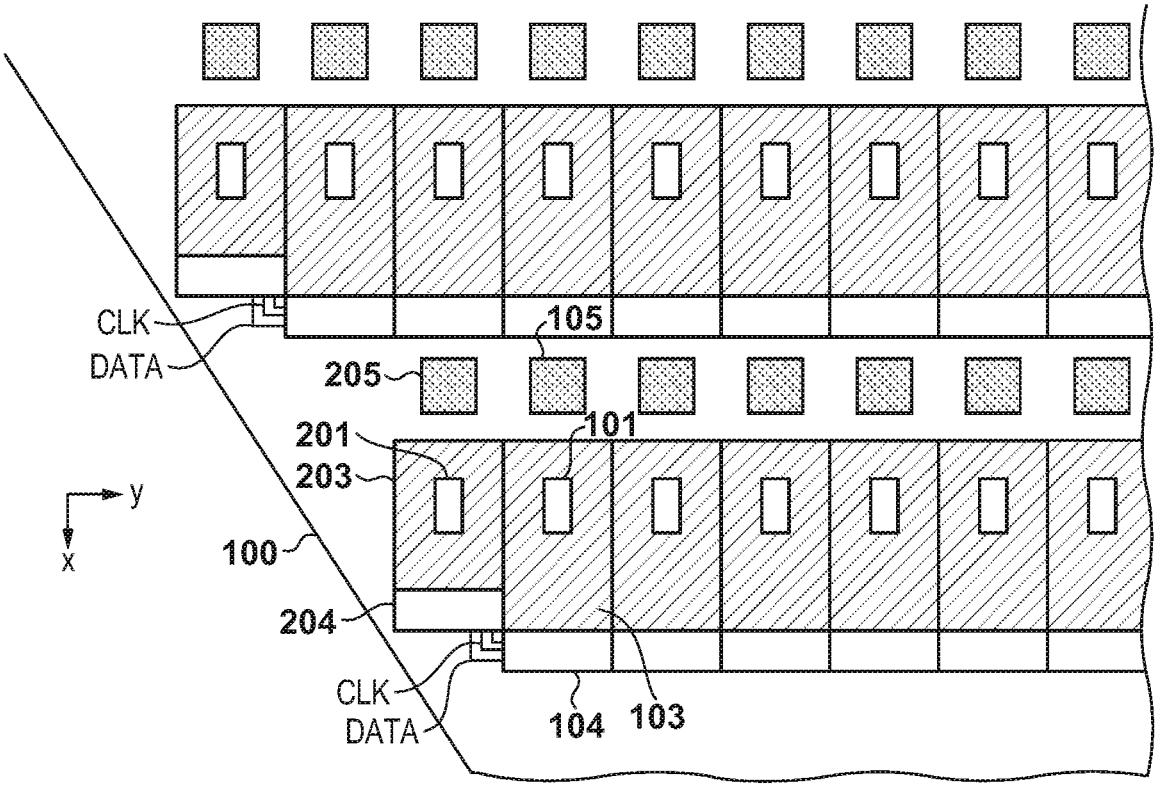
FIG. 9 is a view showing the layout arrangement of an element substrate according to modified example 1 of the second embodiment.

FIG. 9 is a view showing the layout of an element substrate according to modified example 1 of the second embodiment.

As is obvious from comparing FIG. 9 and FIGS. 8A and 8B, the MOS transistor 103 is arranged immediately below each heater 101. As shown in FIG. 9, the MOS transistor 203 corresponding to the dummy heater 201 is arranged immediately below the dummy heater 201, and the circuit size of the MOS transistor 203 is reduced on the x-direction minus side. As a result, the same size reduction effect as that in FIGS. 8A and 8B is obtained.

Modified Example 2

Figure 10:
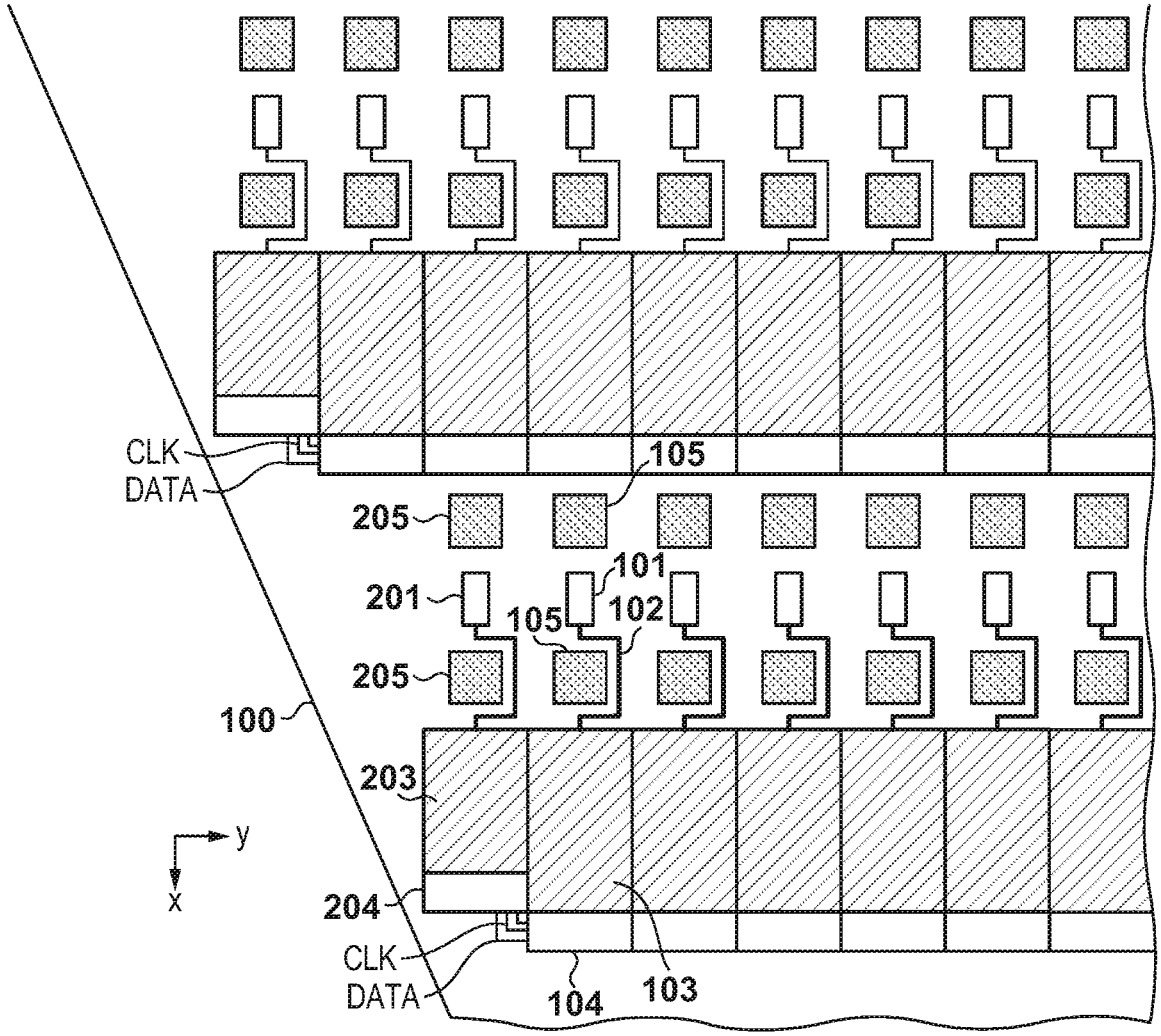
FIG. 10 is a view showing the layout arrangement of an element substrate according to modified example 2 of the second embodiment.

FIG. 10 is a view showing the layout arrangement of an element substrate according to modified example 2 of the second embodiment.

As is obvious from comparing FIG. 10 and FIGS. 8A and 8B, supply ports 105 are arranged on both sides of each heater in the x direction in this example. In the same manner, supply ports 205 are arranged on both sides of the dummy heater 201, respectively, in the x direction in this example. As shown in FIG. 10, the size of the element substrate can be reduced by reducing the circuit size of the MOS transistor 203, corresponding to the dummy heater 201, on the x-direction minus side in the same manner as the example shown in FIGS. 8A and 8B.

Hence, according to the above-described embodiment, the size of the element substrate can be reduced by reducing the MOS transistor corresponding to the dummy heater in the x direction or the y direction. In addition, it is possible to reduce the length between the connecting portions of adjacent element substrates, reduce the ink land position shift amount due to the air flow caused by the conveyance of the print medium during a printing operation, and suppress the ink land position shift even when the print medium is conveyed skewed with respect to the heater array. As a result, high-quality image printing can be achieved in the same manner as the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-025352, filed Feb. 15, 2018, which is hereby incorporated by reference herein in its entirety.

What is claimed is:

1. A multilayer structured element substrate comprising:
an element array in which a plurality of print elements and a dummy element are arranged the dummy element not contributing to printing; and
a first circuit related to driving the plurality of print elements forming the element array, the first circuit being provided so as to be included in a structure of the element substrate,
wherein the dummy element and the first circuit are arranged at a position where the dummy element and the first circuit at least partially overlap each other in a planar view of the element substrate.

2. The element substrate according to claim 1, wherein the dummy element is arranged at an end of the element array.

3. The element substrate according to claim 1, further comprising a plurality of second circuits configured to drive the plurality of print elements, respectively,
wherein the first circuit supplies a data signal and a clock signal to be used by the plurality of second circuits to drive the plurality of print elements.

4. The element substrate according to claim 3, wherein each of the plurality of the second circuits includes a MOS transistor and a selection circuit configured to select the MOS transistor.

5. The element substrate according to claim 4, wherein the MOS transistor and the plurality of print elements are arranged at a position where the MOS transistor and the plurality of print elements at least partially overlap each other in the planar view of the element substrate.

6. The element substrate according to claim 4, further comprising:
a plurality of first openings configured to flow ink in correspondence with the plurality of the print elements; and
wirings configured to connect the MOS transistors to the plurality of print elements, respectively.

7. The element substrate according to claim 6, wherein the wirings are arranged in a layer different from the layer in which the plurality of the print elements are arranged.

8. The element substrate according to claim 6, further comprising a plurality of second openings which sandwich the plurality of print elements with the plurality of the first openings, are arranged between the MOS transistors and the plurality of the print elements, and flow ink in correspondence with the plurality of the print elements,
wherein the wirings are arranged so as to bypass the plurality of the second openings, respectively.

9. The element substrate according to claim 4, wherein the first circuit is a circuit configured to adjust a timing to transfer the data signal and the clock signal to the selection circuit.

10. The element substrate according to claim 1, wherein the first circuit is a decoder configured to expand a data signal for driving the plurality of print elements.

11. The element substrate according to claim 1, wherein the element array includes:
a first dummy element provided on one end of the element array; and
a second dummy element provided on the other end of the element array, and
the function of the first circuit that overlaps the first dummy element is different from the function of the first circuit that overlaps the second dummy element.

12. The element substrate according to claim 1, wherein the element substrate includes a side that forms the outer shape of the element substrate and extends in a direction which intersects with an element array direction in the planar view of the element substrate.

13. The element substrate according to claim 12, wherein a portion of the first circuit which is along the side has a stepwise shape.

14. The element substrate according to claim 1, wherein an outer shape of the element substrate is one of a parallelogram, a trapezoid, and a rectangle.

15. The element substrate according to claim 1, further comprising:
a plurality of the element arrays arranged along a direction in which the plurality of print elements are arranged;
a plurality of the first circuits corresponding to the plurality of the element arrays; and
wirings configured to connect the plurality of the first circuits.

16. The element substrate according to claim 1, wherein the first circuit is configured to drive the plurality of print elements.

17. The element substrate according to claim 1, wherein the dummy element has a same shape as a print element.

18. The element substrate according to claim 1, wherein one face of the element substrate is a first face, and the other face is a second face,
the element array is provided on the first face, and
the first circuit is provided between the first and the second faces.

19. The element substrate according to claim 1, wherein, in the planar view, the dummy element is provided inside the first circuit.

20. The element substrate according to claim 1, further comprising a detection element circuit including a plurality of detection elements configured to detect temperature information in correspondence with the plurality of print elements, respectively,
wherein the first circuit relates to the detection element circuit.

21. A printhead including a plurality of multilayer structured element substrates, each element substrate comprising:
an element array in which a plurality of print elements and a dummy element are arranged the dummy element not contributing to printing; and a first circuit related to driving the plurality of print elements forming the element array, the first circuit being provided so as to be included in a structure of the element substrate, wherein the dummy element and the first circuit are arranged at a position where the dummy element and the first circuit at least partially overlap each other in a planar view of the element substrate, and the plurality of element substrates are arranged along a direction of the element array and are configured to discharge ink by driving the print elements.

22. The printhead according to claim 21, wherein the printhead is a full-line printhead.

23. A printing apparatus for printing an image by discharging ink to a print medium from a printhead, wherein the printhead includes a plurality of multilayer structured element substrates, each element substrate comprising:

an element array in which a plurality of print elements and a dummy element are arranged the dummy element not contributing to printing; and a first circuit related to driving the plurality of print elements forming the element array, the first circuit being provided so as to be included in a structure of the element substrate, wherein the dummy element and the first circuit are arranged at a position where the dummy element and the first circuit at least partially overlap each other in a planar view of the element substrate, and the plurality of element substrates are arranged along a direction of the element array and are configured to discharge ink by driving the print elements.

24. A printhead including a plurality of multilayer structured element substrates, each element substrate comprising:

an element array in which a plurality of print elements are arranged and a dummy element not contributing to printing is included; and a first circuit related to driving the plurality of print elements forming the element array, a plurality of second circuits configured to drive the plurality of print elements, respectively, wherein the dummy element and the first circuit are arranged at a position where the dummy element and the first circuit at least partially overlap each other in a planar view of the element substrate, the plurality of element substrates are arranged along a direction of the element array and are configured to discharge ink by driving the print elements, and the first circuit supplies a data signal and a clock signal to be used by the plurality of second circuits to drive the plurality of print elements.

25. A printhead including a plurality of multilayer structured element substrates, each element substrate comprising:

an element array in which a plurality of print elements are arranged and a dummy element not contributing to printing is included; and a first circuit related to driving the plurality of print elements forming the element array, wherein the dummy element and the first circuit are arranged at a position where the dummy element and the first circuit at least partially overlap each other in a planar view of the element substrate, the plurality of element substrates are arranged along a direction of the element array and are configured to discharge ink by driving the print elements, and the first circuit is a decoder configured to expand a data signal for driving the plurality of print elements.

26. A printing apparatus for printing an image by discharging ink to a print medium from a printhead, wherein the printhead includes a plurality of multilayer structured element substrates, each element substrate comprising:

an element array in which a plurality of print elements are arranged and a dummy element not contributing to printing is included; and a first circuit related to driving the plurality of print elements forming the element array, a plurality of second circuits configured to drive the plurality of print elements, respectively, wherein the dummy element and the first circuit are arranged at a position where the dummy element and the first circuit at least partially overlap each other in a planar view of the element substrate, the plurality of element substrates are arranged along a direction of the element array and are configured to discharge ink by driving the print elements, and the first circuit supplies a data signal and a clock signal to be used by the plurality of second circuits to drive the plurality of print elements.

27. A printing apparatus for printing an image by discharging ink to a print medium from a printhead, wherein the printhead includes a plurality of multilayer structured element substrates, each element substrate comprising:

an element array in which a plurality of print elements are arranged and a dummy element not contributing to printing is included; and a first circuit related to driving the plurality of print elements forming the element array, wherein the dummy element and the first circuit are arranged at a position where the dummy element and the first circuit at least partially overlap each other in a planar view of the element substrate, the plurality of element substrates are arranged along a direction of the element array and are configured to discharge ink by driving the print elements, and the first circuit is a decoder configured to expand a data signal for driving the plurality of print elements.

* * * * *